United States Patent [19]

Dill

[11] 3,990,955

[45] Nov. 9, 1976

[54] ELECTRODEPOSITION OF HARD NICKEL

[75] Inventor: Aloys J. Dill, Tappan, N.Y.

[73] Assignee: The International Nickel Company, Inc., New York, N.Y.

[22] Filed: Nov. 29, 1974

[21] Appl. No.: 527,341

Related U.S. Application Data

[63] Continuation-in-part of Ser. No. 439,303, Feb. 4, 1974, abandoned.

[52] U.S. Cl. ..... 204/49

[51] Int. Cl.[2] ..... C25D 3/12

[58] Field of Search ..... 204/49, 43 T, 43 N, 204/43 P, 44

[56] References Cited

UNITED STATES PATENTS

| | | | |
|---|---|---|---|
| 2,694,041 | 11/1954 | Brown | 204/49 |
| 2,781,305 | 2/1957 | Brown | 204/49 |
| 3,139,393 | 6/1964 | Hartman et al. | 204/49 |
| 3,576,725 | 4/1971 | Passal | 204/49 |

FOREIGN PATENTS OR APPLICATIONS

| | | | |
|---|---|---|---|
| 899,795 | 6/1962 | United Kingdom | 204/49 |

OTHER PUBLICATIONS

Chemical Abstracts, vol. 71, 9002a, p. 476, (1969).
Chemical Abstracts, vol. 73, 116153p, p. 481, (1970).

*Primary Examiner*—G. L. Kaplan
*Attorney, Agent, or Firm*—Francis J. Mulligan, Jr.; Ewan C. MacQueen

[57] ABSTRACT

Sulfur-free hard nickel in thicknesses in excess of about 50 microns is electrodeposited from nickel plating baths containing 1 to about 8 grams per liter (gpl) of aromatic amide.

4 Claims, No Drawings

ELECTRODEPOSITION OF HARD NICKEL

This application is a continuation-in-part of U.S. application Ser. No. 439,303 filed Feb. 4, 1974, now abandoned.

The present invention is concerned with a process of electrodepositing nickel and, more particularly with electro-depositing hard nickel deposits from electroplating baths essentially devoid of electrodepositable sulfur and from which a sulfur-free hard electrodeposit of nickel can be produced.

The term "hard nickel deposits," refers to nickel electrodeposits normally of a thickness of between 200 and 3000 microns which have useful mechanical characteristics either per se as electroformed shapes or as deposits upon substrates. These useful mechanical characteristics are different from and distinct from aesthetic characteristics of brightening, levelling etc. normally considered with regard to the much thinner decorative deposits.

There are two principle known methods whereby hard nickel electrodeposits can be produced. The first method involves codeposition of sulfur (or sulfur compounds) along with nickel from electroplating baths containing reducible sulfur compounds. The sulfur-containing deposits so produced have the disadvantage that if heated to a temperature of about 300° C or higher the deposits tend to become brittle. The other principle known means of increasing the hardness of nickel electrodeposits is to codeposit nickel and up to about 40% (by weight of total deposit) of cobalt. Such cobalt-containing deposits have the disadvantages that materials containing cobalt usually cannot be used in nuclear applications. A useful discussion of these principal known means of increasing the hardness of nickel electrodeposits and other known means is contained in the book "Nickel Plating" by R. Brugger published by Robert Draper Ltd. in 1970.

It has now been discovered that certain organic additives included in relatively small quantities in nickel electroplating baths can increase the hardness of the electrodeposit without embrittling the electrodeposit on heating and without incorporating cobalt in the electrodeposit.

It is an object of the present invention to provide a novel process of producing hard sulfur-free nickel electrodeposits.

Other objects and advantages will become apparent from the following description.

Generally speaking, the present invention contemplates the process of using special nickel-containing electrolytes to electrodeposit hard nickel, such special electrolytes being characterized by containing about 0.5 to about 8 grams per liter (gpl) of an organic, hydrolysis resistant, aromatic sulfur-free carboxylic acid amide and said process being characterized by being conducted for a sufficient period of time to electrodeposit nickel in a thickness of at least about 50 microns. Advantageously, the electrolytes useful in the present invention contain about 1 to about 4 gpl of aromatic amide.

Sulfur-free aromatic carboxylic acid amides found to be operable in the present invention are those, which except for ring unsaturation are saturated and include benzamide, phthalamide and hippuric acid. Other aromatic amides of the same character include substituted benzamides such as orthomethylbenzamide, paramethyl benzamide, metamethyl benzamide, and salicylamide, the hemiamide of phthalic acid, phthalimide, nicotinamide, etc.

The electrolytes contemplated for use in accordance with the present invention including the aromatic amide can be any aqueous electrolyte from which nickel can be electrodeposited. More specifically the electrolytes useful in the present invention can be of the Watts or sulphamate type. Typical compositions of these types of baths are set forth in Table I along with typical operating conditions.

TABLE I

| Ingredient | Watts type bath | Sulphamate |
|---|---|---|
| $Ni\ SO_4 .6H_2O$ | 310 gpl | |
| $Ni\ Cl_2 .6H_2O$ | 50 gpl | 10 gpl |
| $H_3BO_4$ | 40 gpl | 40 gpl |
| $Ni\ (NH_2\ SO_3)_2$ | | 450 gpl |
| Conditions | | |
| pH | 3–4 | 3–4 |
| Cathode Current Density ($A/dm^2$) | 1.5–25 | 1.5–50 |
| Temperature (° C) | 40–70 | 30–60 |

As those skilled in the art are aware such baths are employed using essentially unidirectional current to deposit nickel on a cathode which can be any electroconductive substrate. The baths can be used for plating or deposition where adherence is essential or for electroforming where only a transitory bond between the substrate and the deposit is required. Any form of anode can be used, a particularly useful form being discs of nickel containing small amounts of sulfur and held in a titanium basket. All general plating techniques including but not limited to periodic current reversal, high agitation at high current densities, inclusion of foreign particles in the deposit and the like can be used.

In order to give those skilled in the art a better understanding and appreciation of the invention, the following discussion related to examples of the invention is given.

To study the effect of additive concentration on room temperature hardness of electrodeposited nickel a series of runs were made in a Watts-type bath using various levels of additive. The runs were made in a bath having a nickel sulfate hexahydrate concentration of about 300 gpl, a nickel chloride hexahydrate concentration of 60 gpl, a boric acid concentration of about 30 gpl, a wetting agent (DUPONOL ME) concentration to maintain the surface tension below 35 dyne/cm, a pH of about 4.0, a current density of about 5.4 $A/dm^2$ and a temperature of about 60° C. The hardness of the deposits was determined on deposits about 100 to 150 microns thick using a Tukon microhardness tester with a 500 gram load and a Knoop indenter (Knoop Hardness Number KHN). Results of these runs are set forth in Table II.

TABLE II

| | Additive Concentration | | | | |
|---|---|---|---|---|---|
| Additive | 0 gpl | 1 gpl | 3 gpl | 4 gpl | 8 gpl |

TABLE II-continued

| | Additive Concentration | | | | |
|---|---|---|---|---|---|
| None | 240 KHN | | | | |
| Hippuric Acid | — | 415 KHN | 460 KHN | — | 500 KHN |
| Benzamide | — | 400 KHN | — | 480 KHN | — |
| Phthalamide | — | 405 KHN | — | 475 KHN | — |
| Acetamide | — | 200 KHN | — | 240 KHN | — |

Table II shows that at concentration levels of about 1 to about 8 grams per liter aromatic amides are effective to increase the hardness of nickel electrodeposits made from a Watts-type bath whereas an aliphatic amide, acetamide, was ineffective.

Heat treatment of the nickel deposits having hardnesses of about 400 KHN as set forth in Table II at 300° C and 600° C resulted in a lowering of the hardness. After 4 hours at 300° C the room temperature hardnesses were reduced to within the range of 270 to 360 KHN and after 4 hours at 600° C the room temperature hardnesses were about 120 to 150 KHN. The heat treated hard nickel deposits were in all instances harder than similarly heat-treated Watts nickel. There were no signs of embrittlement on heat treating the hard nickel deposits as evidenced by satisfactory bending of heat-treated specimens. One further observation made with respect to the hard nickel deposits detailed in Table II is the fact that over the concentration range of 1 to 4 gpl both benzamide and phthalamide reduced the internal tensile stress of the nickel electrodeposits whereas hippuric acid increased the internal tensile stress as compared to nickel deposited from the Watts bath containing no additive.

Similar tests were conducted using a sulphamate bath containing 81.0 gpl of nickel as nickel sulphamate 7.5 gpl of nickel chloride hexahydrate, 37.5 gpl of boric acid and similar amounts of wetting agent. Deposits were made from this bath maintained at a pH of 4.0 and a temperature of 60° C at a current density of 2.7 A/dm². The results of hardness testing deposits made under these conditions with varying bath additive are set forth in Table III.

TABLE III

| Additive | Hardness Tested at Room Temperature* | Additive Concentration 0 gpl | 2 gpl | 4 gpl | 6 gpl | 8 gpl |
|---|---|---|---|---|---|---|
| Benzamide | as deposited | 210 | 415 | 485 | 505 | 505 |
| " | after 4 hours at 300° C | 205 | 340 | 390 | 535 | 560 |
| " | after 4 hours at 500° C | 120 | 215 | 255 | 345 | 370 |
| " | after 4 hours at 600° C | 115 | | | | |
| | | 0 gpl | 2 gpl | 4.5 gpl | 8 gpl | |
| Hippuric Acid | as deposited | 210 | 405 | 530 | 580 | |
| | after 4 hours at 300° C | 205 | 335 | 560 | 620 | |
| | after 4 hours at 600° C | 115 | 155 | 200 | 300 | |

*All hardness values in Table III are in Knoop Hardness Numbers (KHN).

Studies of the internal stress of the hard nickel deposits made from sulphamate baths indicate that hippuric acid increases the internal stress to a greater extent than benzamide. Except in those rare instances where high internal tensile stress of a deposit may be desirable, it is advantageous to maintain the aromatic amide concentration in the nickel sulphamate plating bath in the range of about 0.5 to about 5 gpl.

Additional examples of the present invention were carried out to determine with respect to the sulphamate bath the effect of varying current density, plating bath temperature and plating bath pH on hardness and internal tensile stress of the nickel electrodeposit at different levels of concentration of hippuric acid. Data obtained by carrying out these examples is set forth in the following tables.

The first set of these additional examples was carried out with the specific sulphamate bath set forth hereinbefore maintained at 60° C and a pH of 4.0 while the current density and hippuric acid content were varied. Results of testing of nickel deposits obtained in terms of Knoop Hardness Numbers for room temperature hardness (as deposited) and internal stress in hectobars (hbar) are set forth in Table IV.

TABLE IV

| Cathode Current Density (A/dm²) | Concentration of Hippuric Acid 2 gpl Hardness | 2 gpl Internal Stress | 4.5 gpl Hardness | 4.5 gpl Internal Stress |
|---|---|---|---|---|
| 1.1 | 515 | 15.0 | 570 | 27.0 |
| 2.7 | 400 | 13.0 | 525 | 22.0 |
| 5.4 | 325 | 10.5 | 425 | 13.8 |

The second series of additional examples used the same bath having a pH of 4.0 with a current density of 2.7 A/dm² and varied the hippuric acid concentration and the temperature. Results of the type set forth in Table IV are set forth in Table V.

TABLE V

| Temperature (° C) | Concentration of Hippuric Acid 1 gpl | | 2 gpl | | 4.5 gpl | |
|---|---|---|---|---|---|---|
| | Hardness | Internal Stress | Hardness | Internal Stress | Hardness | Internal Stress |
| 49 | 215 | 9.5 | 320 | 12 | 370 | 14 |
| 60 | 300 | 6.5 | 400 | 13 | 525 | 22 |
| 71 | — | 11 | 480 | 18 | — | — |

The third series of additional examples used the same sulphamate bath maintained at 60° C with a cathode current density of 2.7 A/dm$^2$ and varied the hippuric acid concentration and the pH. Results of the type set forth in Tables IV and V are set forth in Table VI.

TABLE VI

| pH | Concentration of Hippuric Acid 1 gpl Hardness | Internal Stress | 2 gpl Hardness | Internal Stress | 4.5 gpl Hardness | Internal Stress |
|---|---|---|---|---|---|---|
| 4.0 | 305 | 6.5 | 400 | 13 | 530 | 22 |
| 4.5 | 395 | 8.5 | 425 | 13 | 550 | 22 |
| 5.0 | 405 | 11 | 470 | 16 | 555 | 25 |

Table IV shows in accordance with the present invention, that by use of a current density in the range of about 0.5 about 1.5 amperes per square decimeter in association with concentrations of hippuric acid in sulphamate baths in the range of about 1.5 to about 3.0 gpl a highly usefully hard nickel electrodeposit can be obtained having minimal internal stress. Table V shows that temperature can affect the hardness of the deposited nickel and therefore should be carefully controlled to obtain optimum results. Table VI shows that as the pH increases within the range of 4 to 5 both the hardness and the internal stress increase for any given hippuric acid concentration.

It is to be noted that while the present invention has been described in terms of concentration of hydrolysis-resistant aromatic amide in nickel plating baths, those skilled in the art will appreciate that the plating bath will contain not only the materials as added but also due to inevitable small amounts of reaction with water, hydrolysis and ionization products thereof. The plating baths of the present invention have been found to be stable over long periods of electrodeposition, e.g., about four weeks. During this time, the concentration of the aromatic amide has decreased from about 8 to about 5.5 grams per liter. No detrimental effect of build-up of hydrolysis products or ionization products has been detected if such a build-up actually occurs. If desired, the aromatic amide can be effectively removed from the electroplating bath by treatment with activated carbon.

Electrodeposits made from a sulphamate bath containing hippuric acid have been analyzed for impurities and no detrimental levels of impurities have been found. Typical analyses of nickel deposits in per cent by weight of impurities correlated to hippuric acid content of the electroplating baths are set forth in Table VII.

TABLE VII

| Concentration of Hippuric Acid (gpl) | Element (%) C | O | N | H | S |
|---|---|---|---|---|---|
| 0 | 0.005 | 0.0056 | 0.0021 | 0.0001 | 0.0005 |
| 1 | 0.005 | 0.0071 | 0.0012 | 0.0001 | 0.0005 |
| 2 | 0.010 | 0.0138 | 0.0046 | 0.0006 | 0.0003 |
| 4.5 | 0.046 | 0.0478 | 0.0138 | 0.0039 | 0.0016 |

As an additional test a nickel deposit was made from a sulphamate bath saturated with salicylamide which exhibited a hardness of about 343.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. A process of nickel electrodeposition comprising electrolyzing an aqueous nickel plating bath containing in addition to nickel salt, about 0.5 to about 8 grams per liter of an organic, saturated, hydrolysis resistant sulfur-free aromatic, carboxylic acid amide at a cathode current density of about 1.5 to about 50 amperes per square decimeter and at a temperature in the range of about 30° to about 70° C for a time sufficient to form a hard deposit at least about 100 microns thick.

2. A process as in claim 1 wherein the bath contains one or more of benzamide, phthalamide or hippuric acid.

3. A process as in claim 1 wherein the bath contains nickel principally as the sulfate or sulphamate and is maintained at a temperature of up to about 60° C.

4. A process of nickel electrodeposition comprising electrolyzing an aqueous nickel plating bath containing in addition to nickel salt selected from the group consisting of nickel sulfate and nickel sulphamate about 1.5 to about 3 grams per liter of hippuric acid at a cathode current density of about 0.5 to about 5.0 amperes per square decimeter and at a temperature in the range of about 30° to about 60° C for a time sufficient to form a hard deposit at least 50 microns thick.

* * * * *